United States Patent [19]

Dellevoet

[11] 4,407,219

[45] Oct. 4, 1983

[54] PILE BRUSH FOR CONDITIONING A MOVING SURFACE

[75] Inventor: John C. Dellevoet, Brugge, Belgium

[73] Assignee: Schlegel Corporation, Rochester, N.Y.

[21] Appl. No.: 283,149

[22] Filed: Jul. 14, 1981

[51] Int. Cl.[3] ..... B05C 11/105

[52] U.S. Cl. ..... 118/60; 118/104; 118/260; 432/60; 15/256.51; 355/3 FU; 401/198; 401/283

[58] Field of Search ..... 432/60; 15/256.51; 355/3 FU; 401/283, 198; 427/429; 118/652, 268, 264, 60, 70, 260

[56] References Cited

U.S. PATENT DOCUMENTS

| | | | |
|---|---|---|---|
| 3,174,174 | 3/1965 | Dengler | 401/283 |
| 3,943,540 | 3/1976 | Vanderheyden | 427/429 X |
| 4,058,085 | 11/1977 | Yang | 118/264 |
| 4,277,161 | 7/1981 | Calabrese | 355/3 FU |

*Primary Examiner*—Shrive P. Beck

*Attorney, Agent, or Firm*—Cushman, Darby & Cushman

[57] ABSTRACT

A brush, especially useful for conditioning the surface of a moving body such as a fuser roll in an electrostatic copying machine, comprises a fibrous pile containing wicking fibers which project outwardly from a liquid-absorbent sponge-like structure so as to conduct liquid from the sponge-like structure and apply it to the surface of the body. The pile may also contain cleaning fibers in the form of monofilaments which remove particulate matter from the surface of the body.

5 Claims, 3 Drawing Figures

PILE BRUSH FOR CONDITIONING A MOVING SURFACE

This invention relates to methods and apparatus for conditioning a moving surface by contact of the moving surface with a brush-like structure which is capable of applying a film of liquid to the surface and which may also be capable of removing particulate material from the surface. In particular, the invention relates to a special pile brush for these purposes. The brush has particular utility in xerographic copying machines for conditioning the surface of the rotating fuser roll used in both hot pressure fusing and cold pressure fusing systems in such machines, so as to eliminate the copy "offset" problem.

BACKGROUND OF THE INVENTION

Conditioning of the surface of a moving body to apply a liquid thereto has typically been carried out in the past by contacting the moving surface with any of a variety of padlike structures. U.S. Pat. No. 3,868,744, for example, discloses a conditioning structure in the form of a wicking assembly for supplying silicone oil to the surface of a heated fuser roll in xerographic reproducing machine. The wicking assembly includes a stationary two-component pad biased against and conforming to a portion of the surface of the fuser roll, the pad consisting of an inner core partially surrounded by a cover which engages the roll surface. Oil is delivered to the core by means of a rotating applicator roll which is partially immersed in a bath of oil. Cleaning of the fuser roll is effected by two cleaning rollers of special construction.

U.S. Pat. No. 4,158,498 discloses a conditioning structure in the form of a doctor blade cleaning device comprising a reservoir of lubricating agent and a plurality of flexible bristles projecting downwardly from the lower surface of the reservoir. The lubricating agent is dispensed through apertures in the bottom wall of the reservoir under the action of flexible blades which extend through the bottom wall and which are disposed so as to be flexed by the doctor blade as it is moved past the blades and the bristles.

U.S. Pat. No. 4,007,983 discloses a conditioning structure in the form of a compressible, flexible pad used to redistribute liquid already existing on the surface of a roll. The pad has a non-absorbent working surface in the form of a pattern of raised and depressed portions. In use the pad is engaged with the wetted surface of a roll with the result that the liquid film is redistributed on the roll surface. The roll surface is an electrostatic imaging surface and the liquid is a liquid developer.

SUMMARY OF THE INVENTION

The present invention provides a pile brush of special construction which enables it to apply a thin uniform film of liquid to a moving surface at a controlled rate. For this purpose the pile brush includes a reservoir for the liquid, and the pile itself includes fibers which are capable of transferring liquid, by a wicking or capillary action, from the reservoir to the moving surface. The reservoir includes a sponge-like body capable of retaining a supply of the liquid. The liquid-conducting wicking fibers of the pile are disposed with their inner end portions in wicking relationship to the sponge-like body. These fibers are preferably multifilament textile fibers which conduct liquid along their lengths by capillary action. In a preferred construction the inner ends of the liquid-conducting fibers are carried by a backing sheet through which they extend. The underside of the backing sheet lies against the sponge-like body so that liquid passes from the latter directly into the wicking fibers.

The pile may also contain other fibers effecting a liquid-spreading and/or cleaning action on the moving surface. These fibers are hereinafter referred to as cleaning fibers in that they are capable of removing particulate matter from the moving surface and entrapping the removed particles, although in some cases the liquid-spreading action may be more important. The cleaning fibers typically should be somewhat stiffer and of greater diameter than the wicking fibers.

As indicated above, the pile fibers are preferably carried by a backing sheet. The pile may be formed by any suitable tufting operation, as by looping a yarn back and forth through a backing sheet and subsequently cutting or shearing the ends of the loops on one side of the sheet to form the pile ends. The pile ends may remain in looped form if desired. The backing sheet is typically a flexible woven fabric which encases the sponge-like reservoir body.

The sponge-like reservoir body is typically made of an open-cell synthetic polymeric foam material or needle punched felt which is compatible with the liquid in the sense of being unreactive with the liquid and being capable of releasably retaining a supply of liquid.

The liquid-transfer characteristics and the cleaning characteristics of the brush are dependent on a number of variables, including the length, density, shape and composition of the fibers, the proportion of wicking fibers to cleaning fibers (if both kinds of fibers are present), the physical properties of the reservoir material, the viscosity of the liquid and the nature of the backing sheet. In use the pressure of the pile against the surface to be conditioned is also a variable which affects liquid-transfer and cleaning, and is a function of the mechanical mounting and firmness of the reservoir material.

The wicking fibers in the pile, as already indicated, are capable of transferring liquid along their lengths, preferably by capillary action. Suitable fibers are, for example, multifilament fibers of synthetic polymeric material or multifilament natural fibers. The chemical composition of the fibers will depend on the particular use of the brush, the material of the surface to be conditioned and the nature of the liquid to be applied to the surface. Multifilament polypropylene fibers are particularly suitable. The length of the fibers can vary considerably, a range of about 1/16 inch to about ½ inch being typical.

The cleaning fibers, when present in the pile, differ from the wicking fibers in having a greater scouring action on the surface to be conditioned.

In general the cleaning fibers are more bristle-like than the wicking fibers in that they are stiffer and/or more abrasive. Monofilaments which are made of synthetic polymeric material and which are of greater diameter than the wicking fibers are suitable. The proportion of cleaning fibers to wicking fibers can vary widely. Further, the cleaning fibers can be distributed either uniformly or non-uniformly throughout the wicking fibers.

An important advantage of the pile brush during use is its ability to supply a controlled amount of liquid to the surface to be conditioned and to spread the liquid evenly on to that surface as a film of uniform thickness.

The supplying and spreading action is superior to that provided by a felt pad, probably because the needling process for making felt results in unwanted holes which have a tendency to cause uneven capillary movement of the liquid from the reservoir. Felt also tends to supply too much liquid, whereas the pile is capable of supplying controlled small amounts of liquid. Further, the pile has a longer life expectancy during use than does felt. While the above-described wicking fibers effect good application and spreading of liquid, it is generally preferred to include cleaning fibers as well in order to enhance spreading while simultaneously effecting a cleaning action by entrapping particulate matter in the brush.

The pile brush has special utility in supplying oil, typically silicone oil, to a fusing roller of an electrostatic copying machine for the purpose of eliminating copy "offset" problems. The copying machine may be, for example, a machine of the kind described in the aforesaid U.S. Pat. No. 3,868,744 the disclosure of which is incorporated herein by reference. While that machine utilizes a hot pressure fusing system, the brush of the present invention is also suitable for use in a cold pressure fusing system. This is accomplished primarily through proper selection of the materials used in the reservoir, the pile backing and the pile fibers. Further the type of pile fibers and mixtures of different pile fibers can be varied to achieve various results. In the simplest case the use of only wicking fibers achieves good uniformity in the application and distribution of controlled amounts of oil. The addition of cleaning fibers to the wicking fibers adds the capability of cleaning the fuser roller surface, while simultaneously achieving improved spreading of the oil film on the roller surface. The cleaning fibers can be provided at distinct locations along the length of the brush in a pattern such that sections of all cleaning fibers are separated from sections of all wicking fibers by fiber-free gaps. Alternatively, the cleaning fibers can be interspersed with the wicking fibers in various patterns. In any event the principal advantage of the pile lies in the quality of oil film distribution. The pile tends to eliminate uneven spread and reduces the risk of flooding. The proper combination of parameters achieves a very low oil consumption, thus achieving a low cost per copy. In addition, the pile reduces clogging compared with felt and this leads to longer life which in turn reduces maintenance costs. Maintenance costs are further reduced in providing longer life to the fuser roller, a relatively expensive part, in the machine. The fuser roller lasts longer because the fuser oil distribution is more uniform. Because of the uniformity of the oil distribution, less maintenance is required in cleaning off excess oil from the roller. Both of these imply that the fuser oil supply lasts longer because it is being more effectively used.

Still further, the pile brush provides a more simple installed system using a pre-assembled component that fits easily into the machine and then is cleanly discarded after use. The brush can thus be supplied in consumable kit form. Also, the brush may obsolete the use of cleaning blades which are currently in use.

DETAILED DESCRIPTION

Figure 1:
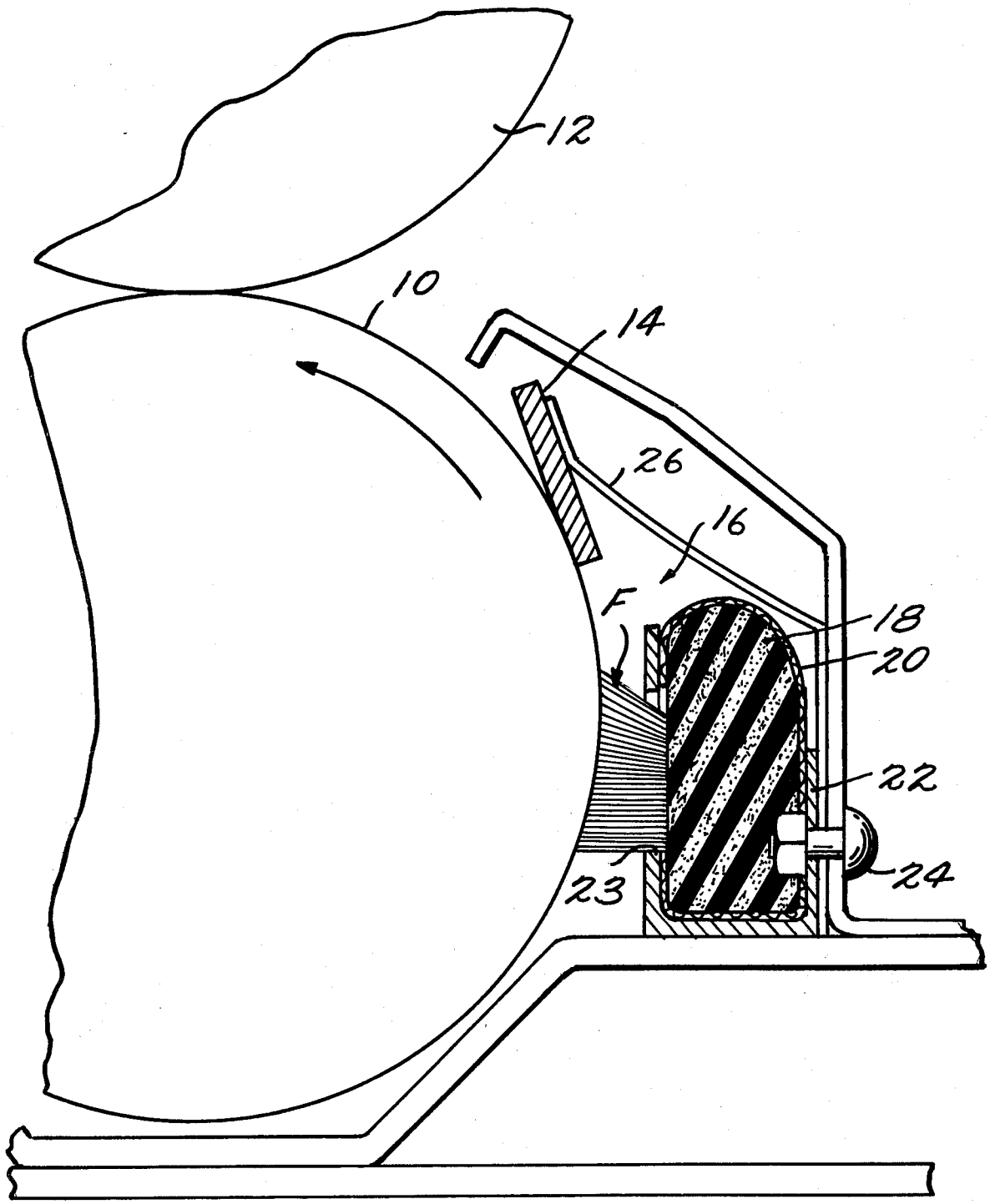
FIG. 1 is a fragmentary schematic sectional view of a pressure fusing system in a xerographic reproducing machine, employing the pile brush of the present invention.

The fuser roll portion of a typical xerographic reproducing machine is illustrated in FIG. 1. The illustrated portion includes a fuser roll 10 and a cooperating pressure roll 12 which may be similar to those disclosed in the aforesaid U.S. Pat. No. 3,868,744. A pile brush assembly 16 embodying the principles of the present invention is located adjacent the fuser roll 10 ahead of the blade 14. The assembly 16 extends along substantially the length of the fuser roll 10.

The principal components of the pile brush assembly 16 are a sponge-like reservoir 18 for releasably retaining a supply of silicone oil, a flexible cover 20 wrapped around the reservoir and a plurality of pile fibers F projecting from the reservoir 18 into contact with the surface of the roll 10. The assembly of reservoir 18, cover 20 and pile fibers F is mounted in a stationary channel member 22 by means of a bolt 24 which passes through the outer leg of the channel member 22. The bolt 24 also clamps in place an arm 26 which carries the blade 14. The pile fibers F extend through a slot 23 in the channel member 22. The mechanical mounting is meant to be representative, other designs could be used.

Figure 2:
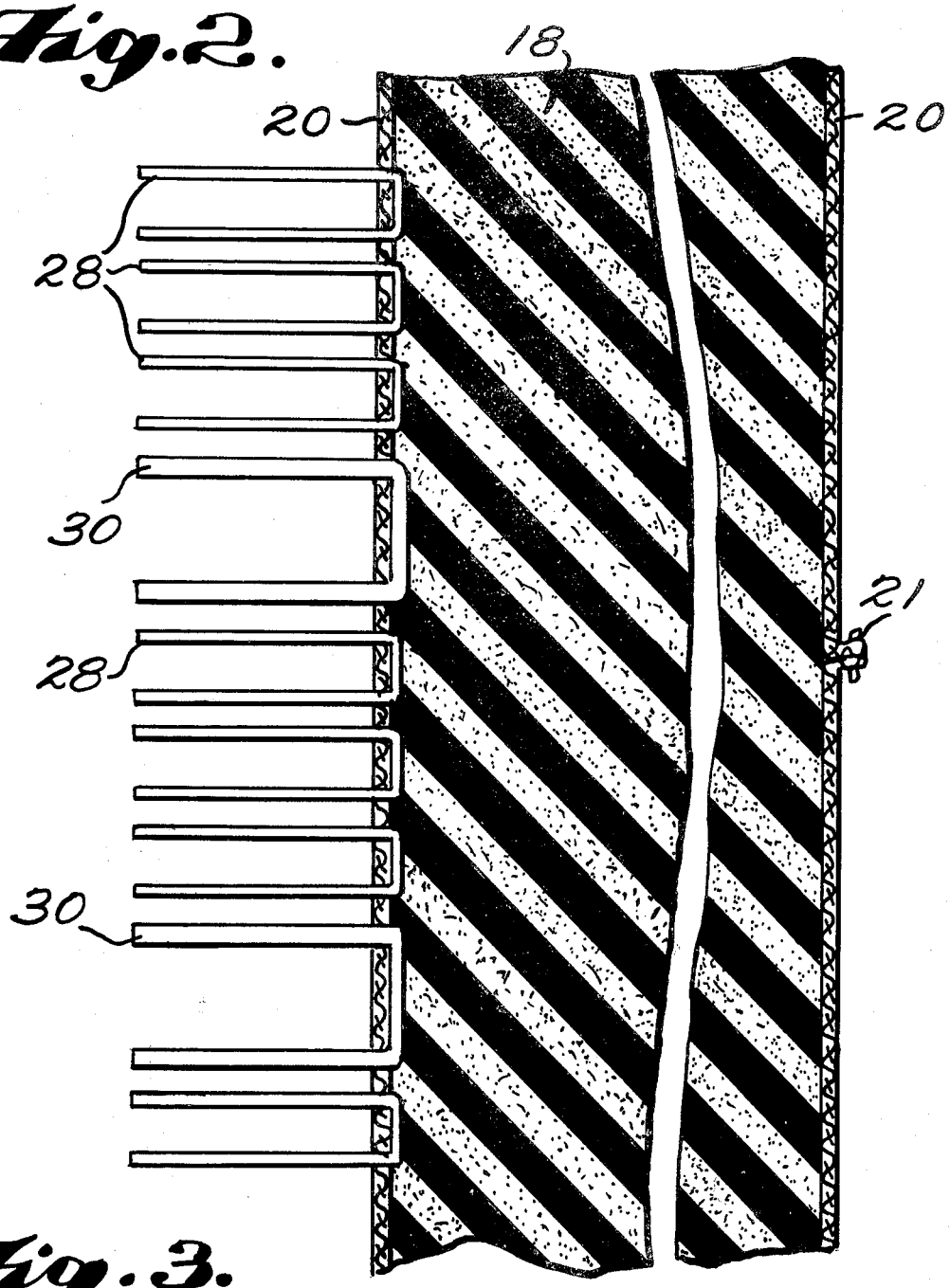
FIG. 2 is a fragmentary sectional view on an enlarged scale of the pile brush of FIG. 1.

As seen in FIG. 2, the pile fibers F are looped through the cover 20 which thereby serves as a backing sheet for the fibers F. The looped portions of the fibers F are in contact with the reservoir 18. The cover 20 or backing sheet in the illustrated embodiment is a woven cotton lace, and the reservoir 18 is a piece of compressible, resilient, open-cell foam of synthetic polymeric material. The hardness of the material is chosen to apply the desired pressure on to the fusing rail to achieve the required rate of liquid application. The cotton lace, after being wrapped around the reservoir 18 has its edges seamed together as shown at 21.

The pile fibers F may all be wicking fibers which are capable of conducting liquid along their lengths by capillary action. Alternatively, some of the fibers F may be cleaning fibers which are stiffer than the wicking fibers and which function to spread the liquid on the surface of the roll 10 and to clean that surface by removing and entrapping particulate material. The embodiment illustrated in FIG. 2 contains both wicking fibers 28 and cleaning fibers 30, the latter being fewer in number than the wicking fibers 28 and generally uniformly interspersed therwith. The wicking fibers 28 are made of multifilament yarn, for example, multifilament polypropylene yarn, with the result that the spaces between filaments effects capillary movement of oil from the reservoir 18 outwardly along the filaments. It is important that the inner end portions of these fibers be in wicking relationship to the reservoir 18 as by being in contact therewith or at least in contact with the porous absorbent cover 20. The cleaning fibers 30 are monofilaments, for example, nylon monofilaments, of greater denier than the multifilament fibers 28. While the inner portions of these fibers 30 are in contact with the reservoir 18 this relationship is not important to their spreading or cleaning function.

Figure 3:
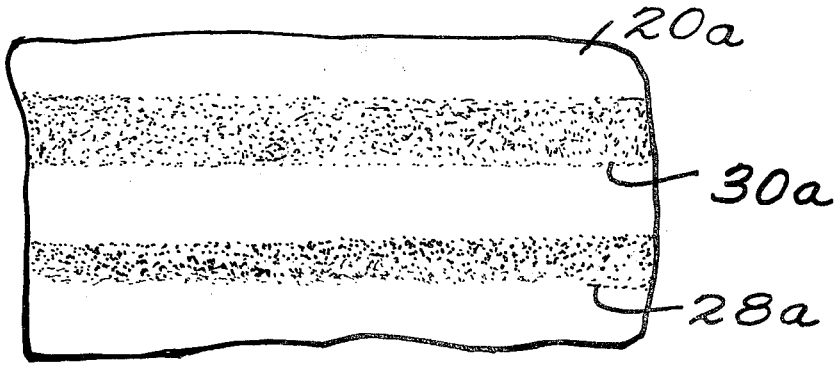
FIG. 3 is a front view on a reduced scale of a second embodiment of a pile brush.

FIG. 3 illustrates a second form of pile brush which is similar to the brush of FIG. 2 except that in the FIG. 3 construction the pile fibers are disposed in spaced-apart sections, some of the sections containing only wicking fibers 28*a* and adjacent sections containing only cleaning fibers 30*a*.

In operation of the system shown in FIGS. 1 and 2 the free end portions of the pile fibers F are in engagement with the surface of the rotating fuser roll 10. Silicone oil is released from the absorbent reservoir 18 to the inner end portions of the wicking fibers 28 and is conducted by capillary action along the fibers 28 to the surface of the roll 10 where it is spread into a thin film of uniform thickness by the end portions of both the wicking fibers 28 and the cleaning fibers 30. Simultaneously the cleaning fibers 30 remove particulate material from the roll surface and entrap the particles in the brush.

What is claimed is:

1. In a fusing system for fusing toner images in an electrostatic copying machine in which a roll surface is used to fix the toner images to copy sheet material, an improved device engageable with the roll for conditioning the surface thereof comprising a liquid-retaining reservoir in the form of a core of compressible, resilient sponge-like material, a woven sheet wrapped around and encasing said reservoir, the portion of said sheet adjacent said roll surface having a brush-like fibrous textile pile layer thereon formed by filaments extending through said sheet, said filaments having outer ends in contact with said roll surface and having inner portions disposed on the side of said sheet facing said reservoir and in wicking contact with said reservoir to thereby conduct liquid from the core to the surface of the roll, the remainder of said sheet being free of pile.

2. Apparatus as in claim 1 wherein said fibers include multifilament yarns capable of conducting liquid along their lengths by capillary action.

3. Apparatus as in claim 2 wherein the fibrous pile also includes cleaning filaments in the form of synthetic polymeric monofilaments which are stiffer and of greater diameter than the multifilament yarns.

4. Apparatus as in claim 1 wherein said core is made of open-cell synthetic polymeric foam material.

5. Apparatus as in claim 1 including a channel-shaped support in which said wrapped core is disposed, said support having an aperture in a wall thereof through which said pile filaments project.

* * * * *